US008564256B2

(12) United States Patent
May

(10) Patent No.: US 8,564,256 B2
(45) Date of Patent: Oct. 22, 2013

(54) CIRCUIT DEVICES AND METHODS OF PROVIDING A REGULATED POWER SUPPLY

(75) Inventor: Michael Robert May, Austin, TX (US)

(73) Assignee: Silicon Laboratories, Inc., Austin, TX (US)

( * ) Notice: Subject to any disclaimer, the term of this patent is extended or adjusted under 35 U.S.C. 154(b) by 955 days.

(21) Appl. No.: 12/620,669

(22) Filed: Nov. 18, 2009

(65) Prior Publication Data

US 2011/0115556 A1 May 19, 2011

(51) Int. Cl.
*G05F 1/613* (2006.01)
*G05F 1/40* (2006.01)

(52) U.S. Cl.
USPC ..... 323/224; 323/284

(58) Field of Classification Search
USPC ..... 323/223–226, 282, 284
See application file for complete search history.

(56) References Cited

U.S. PATENT DOCUMENTS

| | | | | |
|---|---|---|---|---|
| 3,978,393 | A | 8/1976 | Wisner et al. | |
| 4,103,220 | A | 7/1978 | Huntley | |
| 4,238,784 | A | 12/1980 | Keen et al. | |
| 4,327,319 | A | 4/1982 | Swisher et al. | |
| 4,719,404 | A * | 1/1988 | Ekstrand | 323/297 |
| 4,725,769 | A | 2/1988 | Cini et al. | |
| 5,825,674 | A | 10/1998 | Jackson | |
| 6,026,126 | A | 2/2000 | Gaetano | |
| 6,028,417 | A | 2/2000 | Ang et al. | |
| 6,069,521 | A | 5/2000 | Taylor et al. | |
| 6,246,221 | B1 * | 6/2001 | Xi | 323/280 |
| 6,304,131 | B1 | 10/2001 | Huggins et al. | |
| 6,366,522 | B1 | 4/2002 | May et al. | |
| 6,441,594 | B1 | 8/2002 | Connell et al. | |
| 6,445,166 | B2 | 9/2002 | Nishiyama | |
| 6,489,755 | B1 | 12/2002 | Boudreaux, Jr. et al. | |
| 6,509,727 | B2 * | 1/2003 | Fahrenbruch | 323/316 |
| 6,664,848 | B1 | 12/2003 | Gist | |
| 6,853,169 | B2 | 2/2005 | Burstein et al. | |
| 7,233,504 | B2 | 6/2007 | Djenguerian et al. | |
| 2002/0093316 | A1 * | 7/2002 | Fahrenbruch | 323/273 |
| 2003/0006650 | A1 | 1/2003 | Tang et al. | |
| 2008/0088285 | A1 * | 4/2008 | Zhou et al. | 323/271 |
| 2008/0197898 | A1 | 8/2008 | Lin et al. | |

* cited by examiner

*Primary Examiner* — Jessica Han
(74) *Attorney, Agent, or Firm* — Cesari & Reed, LLP; R. Michael Reed

(57) ABSTRACT

In an embodiment, a circuit includes a regulated power supply terminal, a processing circuit coupled to the regulated power supply terminal, and a low frequency responsive circuit having a first transistor adapted to be coupled to a power source and having first circuitry configured to control current flow from the power source through the first transistor to supply a low frequency current to the regulated power supply terminal. The circuit device further includes a high frequency responsive circuit having a second transistor coupled to the regulated power supply terminal and having second circuitry configured to control the second transistor to selectively modulate high frequency current components at the regulated power supply terminal to reduce voltage variations on the regulated power supply.

20 Claims, 7 Drawing Sheets

CIRCUIT DEVICES AND METHODS OF PROVIDING A REGULATED POWER SUPPLY

FIELD

The present disclosure is generally related to a circuit devices and methods of regulating a power supply.

BACKGROUND

Voltage regulators are often used to provide stable power supplies for integrated circuitry, such as microprocessors, logic circuitry, digital signal processors (DSPs), and other circuitry. In an example, a DSP draws a current from the voltage regulator. However, the power consumption of the DSP may vary, causing current spikes that radiate electromagnetic interference (EMI) through magnetic coupling between the power input and nearby receiver circuitry.

One approach for smoothing variations in the input current includes increasing an amount of on-chip charge storage capability, either by adding de-coupling capacitors or by increasing a capacitance of de-coupling or filter capacitors. However, large capacitors increase the cost of the circuit device. Another approach includes regulating the current, which regulation may cause the voltage supplied to the load, such as the DSP, to vary. Such variations can introduce over-voltage and/or under-voltage conditions, which can impact DSP performance. To avoid such under-voltage conditions, the voltage regulator often provides a maximum supply current, regardless of the power consumption of the DSP. However, such maximum supply currents consume more power than is necessary to operate the DSP. Hence, there is a need for a power efficient, digital voltage regulator that is cost effective and that provides high quality regulation.

DETAILED DESCRIPTION OF ILLUSTRATIVE EMBODIMENTS

In low-power environments, such as portable computing systems, Power over Ethernet devices, and other types of portable or low-power devices, power regulator circuitry can be configured to provide a stable power supply with low power consumption. Embodiments of a regulator disclosed below are power efficient and have good reverse power supply rejection.

Figure 1:
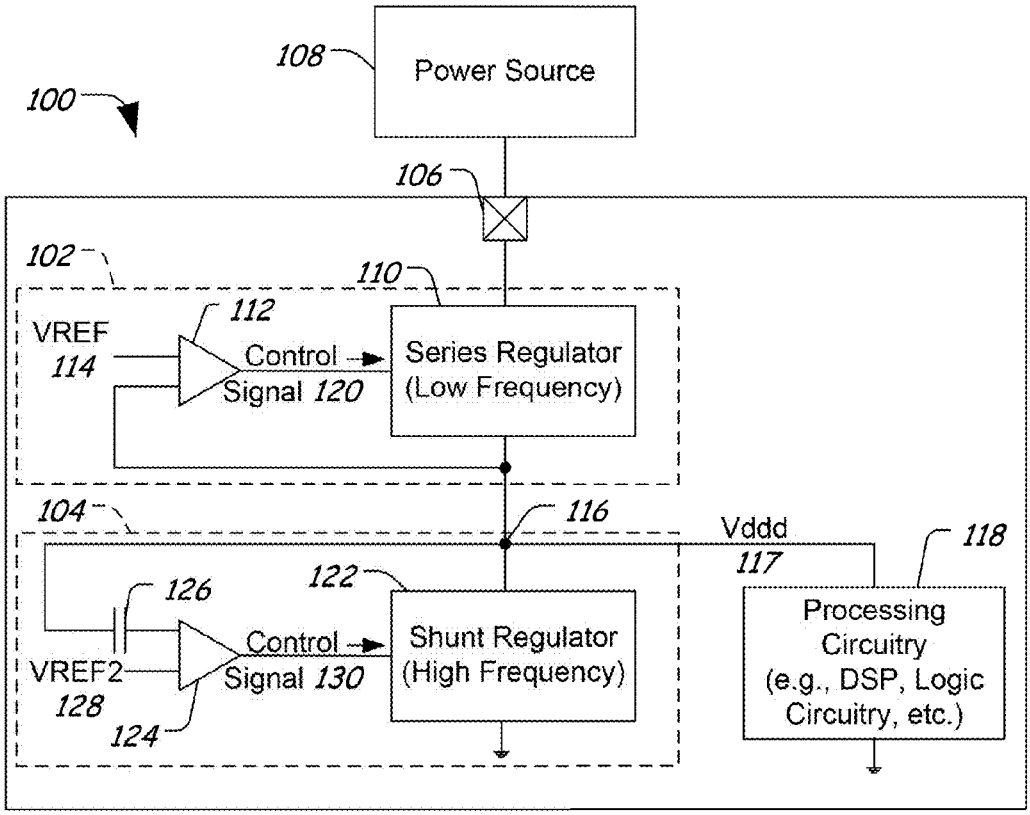
FIG. 1 is a diagram of a circuit device including series regulator circuitry and shunt regulator circuitry configured to provide a regulated digital power supply.

FIG. 1 is a diagram of a circuit device 100 including series regulator circuitry 102 and shunt regulator circuitry 104 configured to provide a regulated digital power supply. The series regulator circuitry 102 is connected to an input 106, which may be a pin, a pad, or another electrically conductive lead. The input 106 is connected to an external power source 108, such as a battery, a rectifier circuit coupled to a power source, such as a Power over Ethernet network cable, other power filtering circuitry, or any combination thereof. The input 106 receives a power supply from the power source 108. In a particular illustrative embodiment, the power supply 108 may be configured to apply approximately 1.8 volts to the input 106.

The series regulator circuitry 102 includes a series regulator 110 that is connected to an amplifier circuit 112. The amplifier circuit 112 has a first input to receive a reference voltage (VREF) 114, which may be digitally programmed to adjust current flow through the series regulator 110. The amplifier circuit 112 further includes a second input coupled to a regulated power supply terminal 116. In an example, the regulated power supply terminal 116 can be a node or electrically conductive trace that delivers a regulated voltage (Vddd) 117 and a supply current to processing circuitry 118, such as a digital signal processor, digital logic circuitry, analog circuitry, power amplifier, radio frequency (RF) mixer, phase lock loop (PLL) circuit, etc. The amplifier circuit 112 is configured to generate a control signal 120 to control operation of the series regulator 110 in response to the reference voltage (VREF) 114 and the regulated voltage (Vddd) 117.

The shunt regulator circuitry 104 includes a shunt regulator 122 that is connected to an amplifier 124. The amplifier 124 has a first input coupled to the regulated power supply terminal 116 through a capacitor 126, which is configured to filter out low-frequency components and to pass through high-frequency components of the regulated voltage (Vddd) 117. The amplifier 124 further includes a second input to receive a second reference voltage (VREF2) 128, which may be the same as the reference voltage (VREF) 114 or a different voltage. The amplifier 124 generates a control signal 130 based on the high frequency components of the regulated voltage (Vddd) 117 and provides the control signal to the shunt regulator 122 to control current flow through the shunt regulator 122.

In an example, during operation, the series regulator circuitry 102 supplies a low frequency current to the regulated power supply terminal 116. The amplifier circuit 112 adjusts current through the series regulator 110 so that the regulated voltage (Vddd) 117 matches the reference voltage (VREF) 114. Additionally, the shunt regulator circuitry 104 allows a nominal current flow through the shunt regulator 122 to ground. Additionally, the shunt regulator circuitry 104 selectively modulates high frequency current components at the regulated power supply terminal 116 by selectively varying current flow through the shunt regulator 122 to reduce voltage variations in the regulated voltage (Vddd) 117.

In a particular example, current drawn by processing circuitry 118 may vary, creating current spikes at the regulated power supply terminal 116. When the processing circuitry 118 is actively processing signals, the processing circuitry 118 may draw more current as compared to when the processing circuitry is idle. In such instances, the shunt regulator circuitry 104 is configured to control variations in the regulated power supply terminal 116. In a particular illustrative example, such current spikes alter the control signal 130 to turn on the shunt regulator 122 to sink the current spikes to ground.

Figure 2:
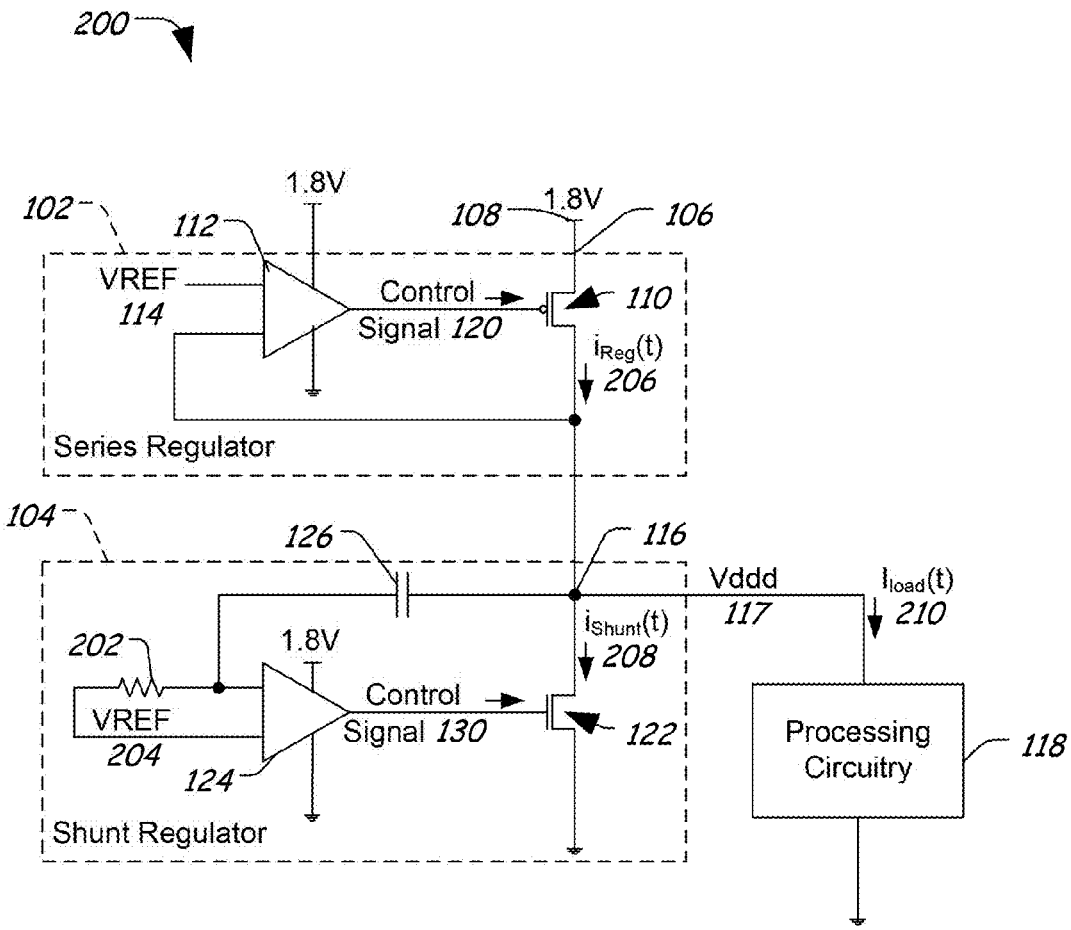
FIG. 2 is a schematic diagram of an embodiment of the series regulator and shunt regulator circuitry of the circuit device of FIG. 1.

FIG. 2 is a schematic diagram of a circuit device 200 of the series regulator circuitry 102 and the shunt regulator circuitry 104 of the circuit device 100 depicted in FIG. 1. For ease of understanding, reference numbers from FIG. 1 are re-used to refer to corresponding elements within the following figures.

In the embodiment shown in FIG. 2, series regulator 110 is a p-channel transistor configured to provide a supply current ($i_{reg}(t)$) 206 to the regulated power supply terminal 116. The supply current ($i_{reg}(t)$) 206 is a time-varying current that can experience low-frequency variations based on variations in power supplied by the power source 108. Accordingly, series regulator circuitry 104 is configured to be responsive to low-frequency variations and to provide a substantially stable supply current to the regulated power supply terminal 116.

Additionally, in this embodiment, shunt regulator 122 is an n-channel transistor configured to shunt high frequency current components, represented by shunt current ($i_{shunt}(t)$) 208, from the regulated power supply terminal 116 to ground. High frequency variations in the regulated power supply terminal 116 may manifest as variations in the voltage (Vddd) 117. Such high frequency variations are coupled to a first input of amplifier 124 through capacitor 126. Resistor 202 provides the low frequency voltage input from (VREF) 204 to a second input of amplifier. In this example, when high frequency variations are not present in the regulated voltage (Vddd) 117 at the regulated power supply terminal 116, the voltages at the first and second inputs of amplifier 124 are substantially equal, and control signal 130 maintains the shunt regulator 122 in a first state, which may direct a nominal shunt current to the ground. When variations are present, the voltages at the inputs to the amplifier 124 vary, causing the control signal 130 to adjust the shunt regulator 122, which may direct more or less shunt current ($i_{shunt}(t)$) 208 to the ground.

Processing circuitry 118 receives a regulated voltage (Vddd) 117 and a time-varying load current ($i_{load}(t)$) 210. As mentioned above, processing circuitry 118 may have time-varying power requirements. For example, if the processing circuitry 118 includes a digital signal processor, the processing circuitry 118 will draw more current when processing data than when the processing circuitry 118 is idle. Such variations in power requirements may cause the processing circuitry 118 to draw more current in some instances and less current in others. Such variation in the current draw can cause the high frequency current and/or voltage variations at the regulated power supply terminal 116.

Current flow in the circuit device 200 is represented by the following equation:

$$i_{reg}(t)=i_{shunt}(t)+i_{load}(t) \quad \text{(Equation 1)}$$

Shunt regulator circuitry 104 does not adjust the direct current (DC) flow through shunt regulator 122, but rather adjusts the high frequency current flow. In particular, the amplifier 124 receives high frequency signal components from the regulated power supply terminal 116 through the capacitor 126. Thus, the series regulator circuitry 102 controls the low frequency current, and the shunt regulator circuitry 104 modulates the higher frequency current components to reduce ripples and variations in the regulated voltage (Vddd) 117 at the regulated power supply terminal 116.

In this particular example, the feedback loop provided by the second input of amplifier 112 automatically adjusts the supply current ($i_{reg}(t)$) 206 to provide an adjusted nominal current through the shunt regulator 122. Further, amplifier 124 can be digitally controlled to adjust current flow through the shunt regulator 122, depending on the desired sensitivity or desired level of ripple control at the regulated power supply terminal 116.

In operation, the series regulator circuitry 102 delivers a supply current ($i_{reg}(t)$) 206 to the regulated power supply terminal 116. When the load current ($i_{load}(t)$) 210 changes, the shunt regulator circuitry 104 can adjust the shunt current ($i_{shunt}(t)$) 208 to source or sink the current, allowing the regulated supply current ($i_{reg}(t)$) 206 to remain substantially constant.

Figure 3:
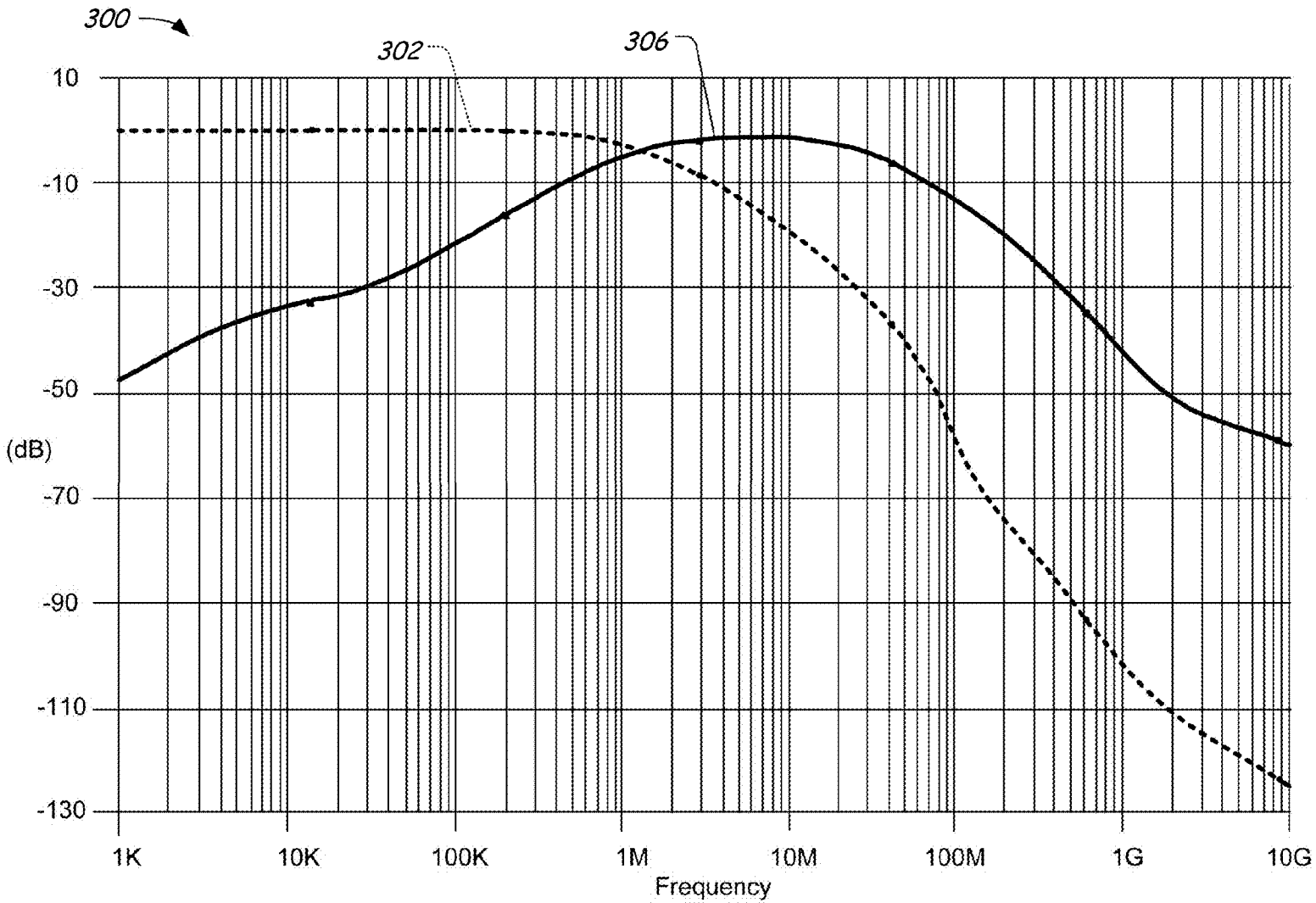
FIG. 3 is graph of a representative example of high frequency and low frequency currents in the series regulator and the shunt regulator, respectively, of the circuit device depicted in FIG. 2.

FIG. 3 is graph 300 of a representative example of high frequency and low frequency currents in the series regulator and the shunt regulator, respectively, of the circuit device 200 depicted in FIG. 2. In the circuit device 200, the processing circuitry 118 is an alternating current source that varies the load current ($i_{load}(t)$) 210. Low frequency components of the load current ($i_{load}(t)$) 210 are supplied by the series regulator circuitry 102 and high frequency components are supplied or shunted to ground by the shunt regulator circuitry 104. Low frequency current flow through the series regulator circuitry 102 is represented by dashed line 302, and high frequency current flow through the shunt regulator circuitry 104 is represented by solid line 304.

As shown, in this particular example, series regulator circuitry 102 supplies low frequency current 302 from approximately DC to approximately 1 MHz, at which frequency the low-frequency current 302 begins to decrease. Thus, low-frequency currents 302 are supplied through the series regulator circuitry 102 from approximately DC to approximately 1 MHz. High frequency current 304 through the shunt regulator circuitry 104 increases from approximately 1 kHz to approximately 1 MHz and then begins to decrease at frequencies approaching 100 MHz. At frequencies above 100 MHz, parasitic the shunt regulator circuitry 104 continues to deliver or shunt the high frequency components, but the circuit performance rolls off due to practical band-limited operation of the shunt regulator circuitry 104.

Figure 4:
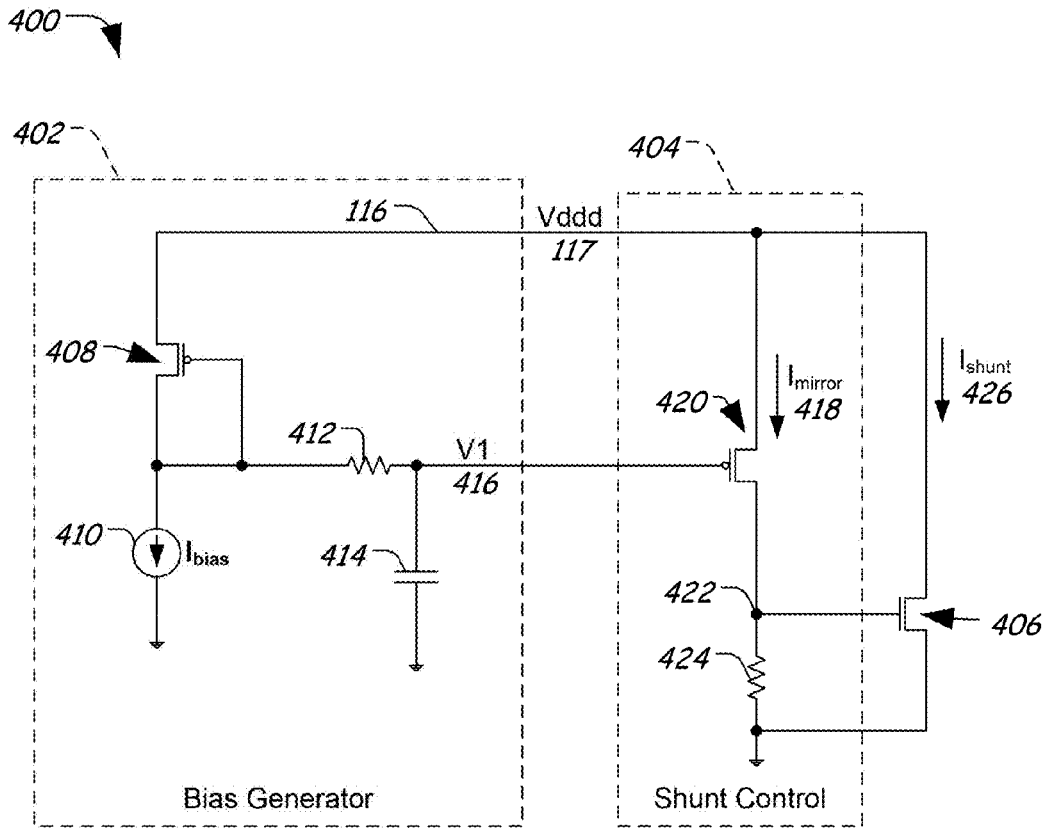
FIG. 4 is a schematic diagram of an alternative embodiment of a shunt regulator circuit.

FIG. 4 is a schematic diagram of an alternative embodiment of a shunt regulator circuit 400. Shunt regulator circuit 400 is coupled to the regulated power supply terminal 116 to receive the regulated voltage (Vddd) 117. The shunt regulator circuit 400 includes a bias generator circuit 402, a shunt control circuit 404, and a shunt transistor 406.

The bias generator circuit 402 includes a p-channel transistor 408 having a source terminal connected to the regulated power supply 116, a drain terminal connected to a bias current source 410, and a gate (control) terminal connected to the drain terminal. The bias generator circuit 402 further includes a resistor 412 connected to the drain and gate terminals of the p-channel transistor 408 and coupled to ground through a capacitor 414. The resistor 412 and capacitor 414 cooperate to provide a voltage (V1) 416 to the shunt control circuit 404.

The shunt control circuit 404 includes a p-channel transistor 420 having a source terminal connected to the regulated power supply terminal 116, a gate terminal connected to the resistor 412 to receive the voltage (V1) 416, and a drain terminal connected to a node 422. The node 422 is coupled to ground through a resistor 424. Additionally, the node 422 is connected to a gate terminal of shunt transistor 406, which includes a drain terminal connected to the regulated power supply terminal 116 and a source terminal connected to ground.

In an example, the p-channel transistor 408 is forward biased to draw a nominal current, which is mirrored through p-channel transistor 420 in the shunt control circuit 404. The mirror current ($I_{mirror}$) 418 flows through transistor 420. As the regulated voltage (Vddd) 117 changes, the voltage (V1) 416 on the control terminal of the p-channel transistor 420 is held fixed by the resistor 412 and the capacitor 414, causing the transistor 420 and resistor 424 to amplify the changes in the regulated voltage (Vddd) 117, adjusting current flow ($I_{shunt}$) 426 through the shunt transistor 406. Thus, the shunt current ($I_{shunt}$) 426 through the shunt transistor 406 is varied based on the changes in the regulated voltage (Vddd) 117.

Though resistor 424 is depicted as a discrete resistor component, it should be understood that the resistance of resistor 424 can be implemented in a variety of ways. In one particular illustrative example, the resistance can be implemented as a diode-connected transistor. Regardless of how the resistance is implemented, the mirror ratio from resistor 424 to shunt transistor 406 can set a nominal shunt current in the shunt regulator circuit 400, which nominal shunt current can be adjusted to sink or source current to supplement the load current ($i_{load}(t)$) 210 (depicted in FIG. 2) at the regulated power supply terminal 116.

In an embodiment, the effective resistance of the shunt regulator circuit 400, looking into the drain of the shunt resistor 406 can be determined according to the following equation:

$$\Delta Vddd * g_{420} * R_{424} * g_{406} = \Delta I\text{shunt}_{426} \quad \text{(Equation 2)}$$

In Equation 2 above, the variable (g) is the transconductance of the particular transistor identified by reference number. Accordingly, the variables ($g_{420}$ and $g_{426}$) represent the transconductances of the p-channel transistors 420 and 426, respectively. Thus, the effective resistance of the shunt regulator circuit 400 as seen from the regulated power supply terminal 116 can be understood from the following equation:

$$\frac{\Delta}{\Delta_{426}} = R \quad \text{(Equation 3)}$$

Equation 3 can be rewritten as follows:

$$\frac{\Delta}{\Delta} = \frac{}{**} \quad \text{(Equation 4)}$$

Figure 5:
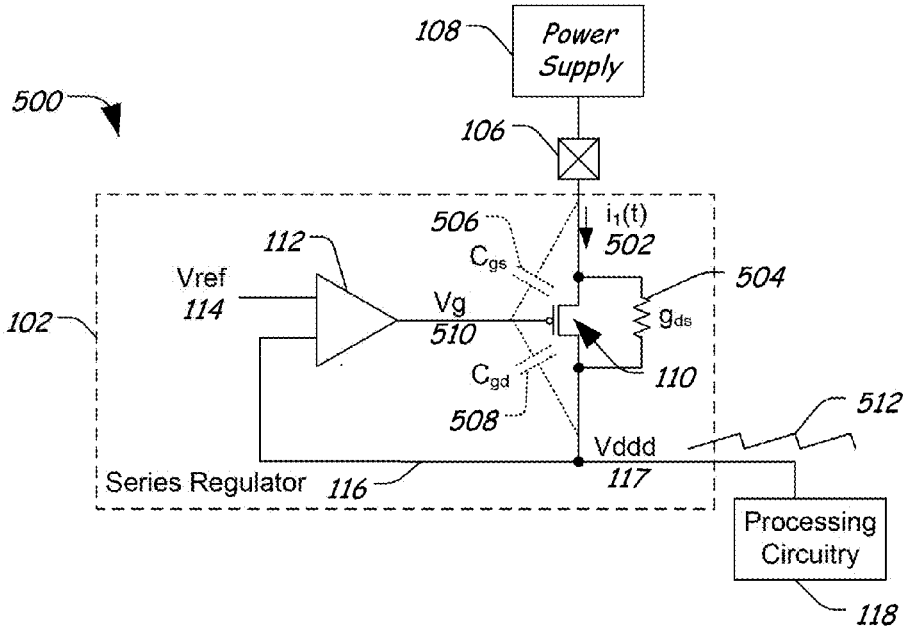
FIG. 5 is a schematic diagram of an embodiment of the series regulator circuitry of the circuit device depicted in FIG. 2.

FIG. 5 is a schematic diagram of an embodiment 500 of the series regulator circuitry 102 of the circuit device 200 depicted in FIG. 2. As shown, the series regulator 110, implemented as a p-channel transistor, has a gate-source capacitance Cgs 506, a gate-drain capacitance Cgd 508 and a drain-source transconductance (gds) 504. A power supply current ($i_1(t)$) 502 flows from the input 106 through the series regulator 110 to the regulated power supply terminal 116. A gate voltage (Vg) 510 is present on the gate of the series regulator 110.

In a typical series regulator, there is a finite reverse power supply rejection resistance due to the drain-source transconductance (gds) 504 and the gate-drain capacitance (Cgd) 506 of the series regulator 110, particularly when the series regulator is implemented as a metal oxide semiconductor field effect transistor (MOSFET) as shown. As the processing circuitry 118 produces current transients on the regulated power supply terminal 116, the supply voltage (Vddd) 117 varies, producing the time-varying signal 512. As the supply voltage (Vddd) 117 modulates, the drain-source voltage of the series regulator 110 modulates, causing current to flow in the power supply 108 due to transconductance (gds) 504. Additionally, charge is injected on the gate of the series regulator 110 due to the gate-drain capacitance (Cgd) 508. Thus, the current in the series regulator 110 can change according to the following equation:

$$\frac{}{} **( )=( ) \quad \text{(Equation 5)}$$

In the illustrative example provided by the circuit device 500 depicted in FIG. 5, the reverse power supply rejection resistance of the series regulator 110 can be understood according to the follow equation:

$$+\frac{}{} *\Delta=\Delta \quad \text{(Equation 6)}$$

Equation 6 is a relatively simple expression, which can be thought of as a simple alternating current (AC) resistor connecting the regulated power supply terminal 116 to the power supply 108. The variable (g) refers to the transconductance of the component or factor identified by the respective reference number.

Figure 6:
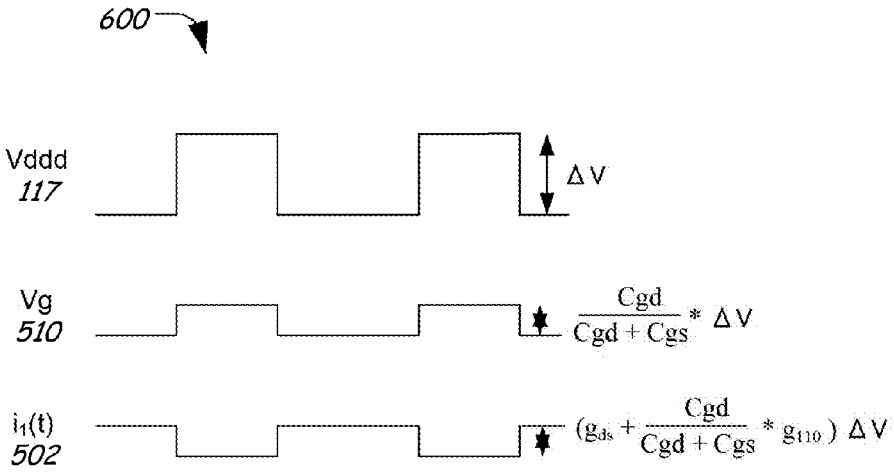
FIG. 6 is a diagram of a regulated voltage, a gate voltage, and a supply current within the series regulator of FIG. 5.

FIG. 6 is a diagram 600 of the regulated voltage (Vddd) 117, the gate voltage (Vg) 510, and the supply current ($i_1(t)$) 502 within the series regulator 500 of FIG. 5. As shown the variance or peak-to-peak amplitude of the variations in the regulated voltage (Vddd) 117 is approximately equal to ΔV. The gate voltage (Vg) 510 varies with the regulated voltage (Vddd) 117, but has a peak-to-peak amplitude that is proportional to the parasitic capacitances according to the following equation:

$$\frac{}{} *\Delta \quad \text{(Equation 7)}$$

Further, the supply current ($i_1(t)$) 502 varies with and is inverted relative to the regulated voltage (Vddd) 117. The supply current ($i_1(t)$) 502 also has a relatively small peak-to-peak amplitude, which is a function of the capacitances and the transconductance of the series regulator 110. The supply current ($i_1(t)$) 502 can be determined according to equation 6.

It is desirable to improve the reverse power supply rejection resistance. In theory, the goal is to synthesize a negative resistance of approximately equal value to one over the conductance shown in Equation 6 so that the change in current in the power supply 108 is zero when the regulated voltage (Vddd) 117 changes, providing enhanced reverse power supply rejection ratio. Additionally, a shunt capacitance also exists around the series regulator 110, which shunt capacitance can also be reduced or cancelled, as discussed below with respect to FIG. 7.

Figure 7:
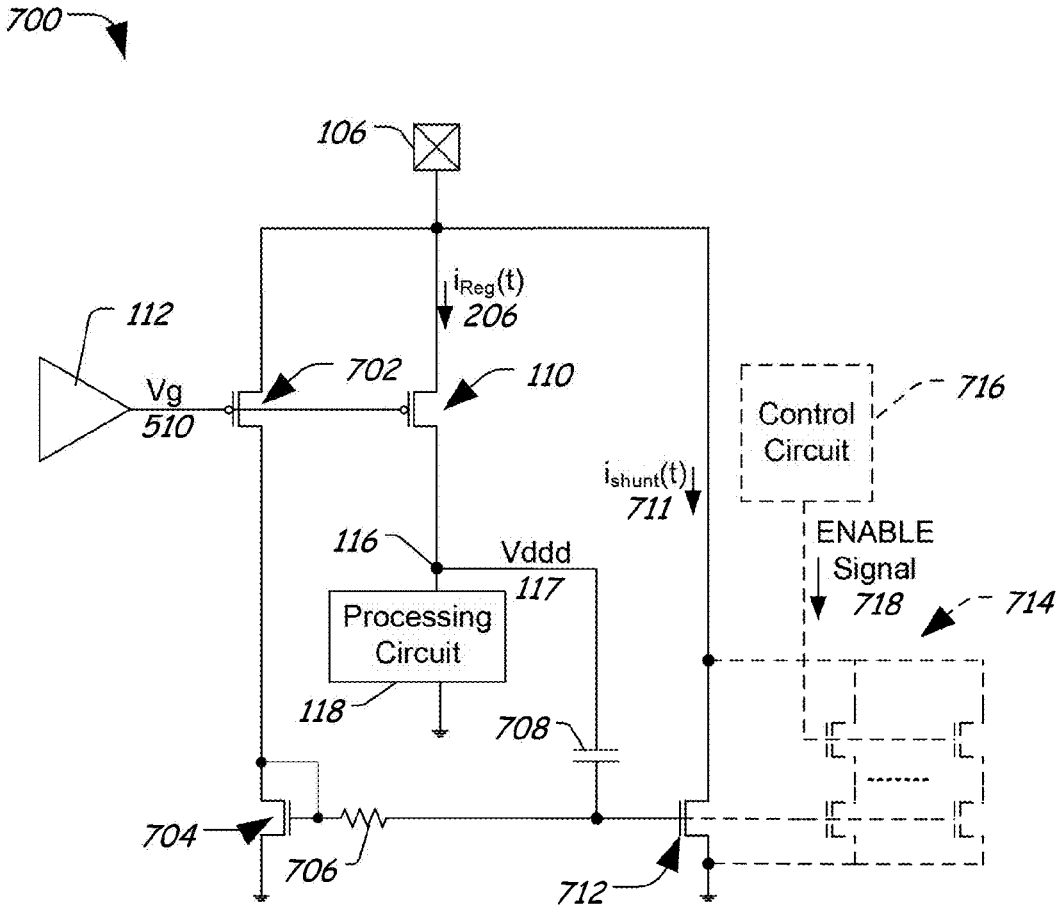
FIG. 7 is a partial schematic and partial block diagram of a second embodiment of the circuit device including series and shunt regulator circuitry configured to provide enhanced reverse power supply rejection.

FIG. 7 is a partial schematic and partial block diagram of a second embodiment of the circuit device 700 including series and shunt regulator circuitry configured to provide enhanced reverse power supply rejection. The circuit device 700 includes the series regulator 110 having a source terminal connected to the input 106, a gate terminal connected to an output of the amplifier 112 to receive the gate voltage (Vg) 510, and a drain terminal connected to the regulated power supply terminal 116. As previously discussed, the series regulator 110 provides a regulated current ($i_{reg}(t)$) 206 to the regulated power supply terminal 116.

The circuit device 700 further includes a first MOSFET 702 having a source terminal connected to the input 106, a gate terminal connected to the gate terminal of the series regulator 110 in a common gate configuration, and a drain terminal that is connected to a drain terminal of a diode-connected transistor 704, which has a source terminal connected to ground. A gate terminal of the diode-connected MOSFET 704 is coupled to a gate terminal of a shunt transistor 712 through a resistor 706. The shunt transistor 712 includes a drain terminal connected to the input 106, a gate terminal coupled to the regulated power supply terminal 116 through a capacitor 708 to receive high frequency signal components, and a source terminal connected to ground.

In an example, transistors 702 and 704 mirror the current ($i_{reg}(t)$) 502 into the shunt transistor 712. The capacitor 708 forces variations in the supply voltage (Vddd) 117 from the regulated power supply terminal 116 onto the gate terminal of the shunt transistor 712, producing a shunt current ($i_{shunt}(t)$ 711) flow through the shunt transistor 712 according to the following equation:

$$h=*\Delta \quad \text{(Equation 9)}$$

In Equation 9, the variable ($g_{712}$) represents a transconductance of the shunt transistor 712.

In a particular example, when the processing circuit 118 causes the supply voltage (Vddd) 117 to decrease, the finite reverse power supply rejection resistance of the series regulator 110 causes more current to be drawn from the power supply 108 through the input 106. Concurrently, the capacitor 708 decreases a gate voltage on the gate terminal of the shunt transistor 712, reducing the drain current in the shunt transistor 712. Thus, the change in current through the series regulator 110 can be balanced approximately or canceled by the change in current in the shunt transistor 712.

In some embodiments, a control circuit 716 may be used in connection with the circuit device 700 to monitor various parameters and to adjust a transistor circuit to improve matching. For example, measuring nominal values of the supply voltage (Vddd) 117 and the input supply at the input 106 will affect the transconductance of the series regulator 110 and of the drain-source resistance 504 (depicted in FIG. 5) under heavy load conditions. The measurements can be used to adjust the transconductance of the shunt transistor 712 digitally, for example by selectively activating or collapsing one or more parallel transistors of a transistor array 714 using one or more enable signals 718.

For example, process and temperature variations can impact the reverse power supply rejection resistance. The control circuit 716 may use such changes to selectively activate or collapse elements of the transistor array 714 to provide more accurate cancellation the reverse power supply rejection resistance. Since the transconductance of the series regulator 110 is a function of both current, temperature, and process variations, the control circuit 716 is configured to attempt to match the transconductance with the transistor array 714, which may be composed of metal oxide semiconductor field effect transistor (MOSFET) devices biased at a similar operating point.

In an embodiment, the circuit 700 is a regulator circuit to provide a regulated power supply from an external power source (such as power source 108 in FIG. 1) that is coupled to input terminal 106. The series regulator 110 is coupled between the input terminal 106 and the regulated power supply terminal 116. The capacitor 708 operates as a voltage sensing circuit that is coupled to the regulated power supply terminal 116 and adapted to produce an output related to a voltage of the regulated power supply (Vddd) 117. The shunt transistor 712 is responsive to the output of the capacitor 708 to produce a cancellation current ($i_{shunt}(t)$ 711) to cancel transient current flow through the series regulator 110.

It should be understood that the circuit device 700 represents only one possible implementation of a reverse power supply rejection resistance cancellation circuit out of many possible implementations. Further, the principle of matching the transconductance of the shunt resistor 706 to the transconductance of the series regulator 110 may be applied to provide improved reverse power supply rejection resistance.

Figure 8:
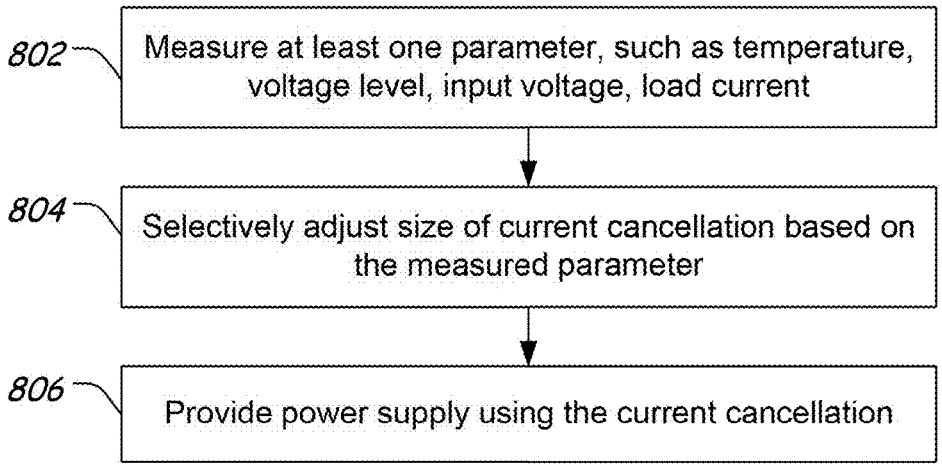
FIG. 8 is a flow diagram of an embodiment of a method of providing a regulated digital power supply.

FIG. 8 is a flow diagram of an embodiment of a method of providing a regulated digital power supply. In an embodiment, the method may be implemented using the circuit device 700 depicted in FIG. 7. In such an instance, sense circuitry (not shown) may be included to measure selected parameters and to provide the measurement data to the control circuit 716.

Turning to the method, at 802, at least one parameter is measured, such as temperature, supply voltage level, input voltage level, load current, or another parameter. For example, the nominal value of the regulated voltage (Vddd) 117 and the power supply provided at the input 106 can be measured to determine the gate-source transconductance and the transistor transconductance parameters under various load conditions. Advancing to 804, the size of the current cancellation is selectively adjusted based on the measured parameter. In an example, selected elements within the transistor array 714 may be activated or collapsed to alter the shunt current flow and to adjust the transconductance of the shunt transistor 706 digitally. Continuing to 806, a power supply is provided using the selected current cancellation.

Figure 9:
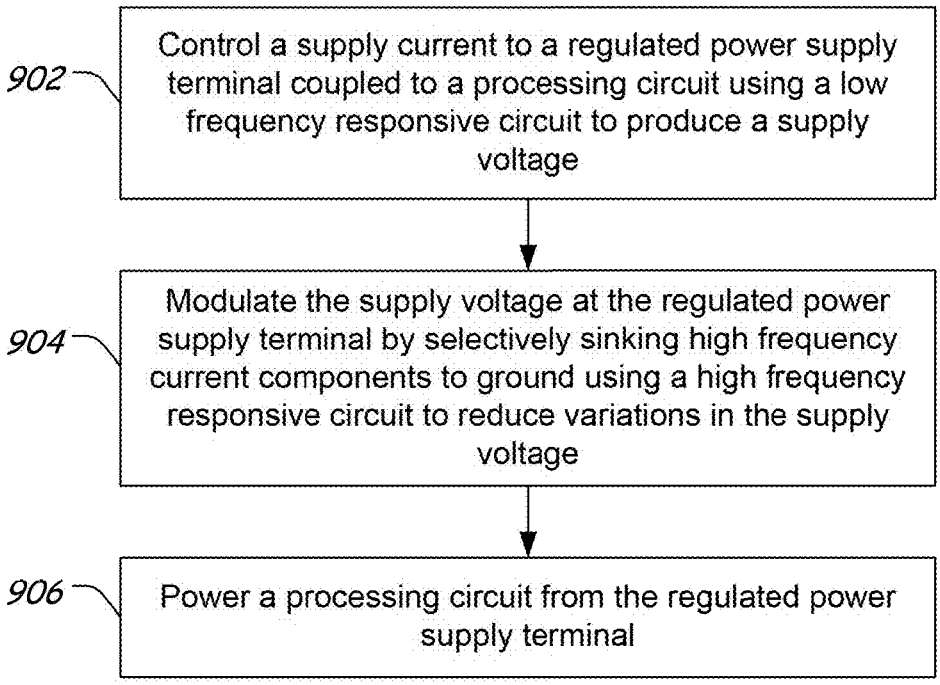
FIG. 9 is a flow diagram of a second embodiment of a method of providing a regulated digital power supply.

As discussed above, the power supply may vary based on the operating state of the load circuitry. However, the improved transconductance matching is configured to provide improved reverse power supply rejection resistance, which prevents current flow into the power supply FIG. 9 is a flow diagram of a second embodiment of a method of providing a regulated power supply. At 902, a supply current to a regulated power supply terminal coupled to a processing circuit is controlled using a low frequency responsive circuit to produce a supply voltage. Advancing to 904, the supply voltage at the regulated power supply terminal is modulated by selectively sinking high frequency current components to ground using a high frequency responsive circuit to reduce variations in the supply voltage. In an embodiment, modulating the supply voltage at regulated power supply terminal includes comparing variations of supply voltage to a threshold to produce a control signal and controlling a transistor within the high frequency responsive circuit to selectively shunt the high frequency current components to ground based on the control signal. Continuing to 906, a processing circuit is powered from the regulated power supply terminal.

In another embodiment, the method further includes feeding back the supply voltage from the regulated power supply terminal to the low frequency responsive circuit, comparing the supply voltage to a reference voltage to determine a difference, and selectively adjusting the supply current to the regulated power supply terminal based on the determined difference.

In a particular embodiment, the supply voltage is modulated by providing high frequency components of the supply voltage through a capacitor to an input of a amplifier that is configured to compare the high frequency components to a threshold. In this instance, the amplifier is configured to produce an output to control a transistor of the high frequency responsive circuit to selectively sink the high frequency current components to ground.

In conjunction with the circuit devices and methods described above with respect to FIGS. 1-9, a regulator circuit is disclosed that includes a series regulator circuit to supply low-frequency current components to a regulated power supply terminal. The digital regulator circuit further includes a shunt regulator circuit to selectively sink or source high frequency components from or to the regulated power supply terminal, to power a load circuit, such as a signal processor circuit. The series regulator circuit is configured to maintain a regulated supply voltage (Vddd) at the regulated power supply terminal at a level that is approximately equal to a selected reference voltage. The shunt regulator circuit is configured to sink or source high-frequency components of the regulated supply voltage (Vddd), which may be caused by variations in current drawn by the load circuitry. The various embodiments allow for a less-than-maximum current flow through the series regulator without producing under-voltage conditions, allowing for a favorable tradeoff between power consumption and load circuit performance.

Although the present invention has been described with reference to preferred embodiments, workers skilled in the art will recognize that changes may be made in form and detail without departing from the spirit and scope of the invention.

What is claimed is:

1. A circuit comprising:

a regulated power supply terminal;

a processing circuit coupled to the regulated power supply terminal;

a low frequency responsive circuit including a first transistor adapted to be coupled to a power source and including first circuitry configured to control current flow from the power source through the first transistor to supply a low frequency current to the regulated power supply terminal; and a high frequency responsive circuit including a second transistor coupled to the regulated power supply terminal and including second circuitry configured to control the second transistor to selectively modulate high frequency current components at the regulated power supply terminal to reduce voltage variations on the regulated power supply terminal.

2. The circuit of claim 1, wherein the processing circuit comprises a digital circuit.

3. The circuit of claim 1, wherein the second circuitry includes an amplifier circuit having a first input configured to receive a reference voltage and having a second input coupled to the regulated power supply terminal through a capacitor.

4. The circuit of claim 3, wherein the amplifier circuit is adjustable to adjust a sensitivity of the high frequency responsive circuit to the high frequency current components.

5. The circuit of claim 1, wherein the first circuitry includes an amplifier circuit comprising:

a reference input to receive a reference voltage signal;

a feedback input coupled to the regulated power supply terminal; and an output coupled to a control terminal of the first transistor to control the current flow through the first transistor.

6. The circuit of claim 1, wherein the high frequency responsive circuit comprises:

a bias generator circuit configured to generate a bias voltage based on a bias current;

a shunt control circuit coupled to the bias generator circuit and configured to generate a shunt control signal; and the second transistor having a control terminal responsive to the shunt control signal.

7. A method of providing a regulated power supply, the method comprising:

controlling the regulated power supply provided to a regulated power supply terminal using a low frequency responsive circuit to produce a supply voltage;

comparing variations of the supply voltage to a threshold to produce a control signal;

modulating the supply voltage at the regulated power supply terminal by selectively sinking high frequency current components to ground in response to the control signal using a high frequency responsive circuit to reduce variations in the supply voltage; and powering a processing circuit from the regulated power supply terminal.

8. The method of claim 7, wherein modulating the supply voltage at regulated power supply terminal comprises:

controlling a transistor within the high frequency responsive circuit to selectively shunt the high frequency current components to ground based on the control signal.

9. The method of claim 7, further comprising:

feeding back the supply voltage from the regulated power supply terminal to the low frequency responsive circuit;

comparing the supply voltage to a reference voltage to determine a difference; and selectively adjusting the supply current to the regulated power supply terminal based on the difference.

10. The method of claim 7, wherein comparing the variations of the supply voltage comprises:

coupling the high frequency components of the supply voltage to an input of an amplifier;

receiving a threshold signal at a second input of the amplifier; and producing the control signal at an output of the amplifier to control a transistor of the high frequency responsive circuit to selectively sink the high frequency current components to ground.

11. The method of claim 7, wherein modulating the supply voltage at the power supply regulated power supply terminal comprises:

receiving the supply voltage from the regulated power supply terminal at the high frequency responsive circuit;

generating a bias current at a bias generating circuit;

amplifying changes in the supply voltage at a shunt control circuit coupled to the bias generating circuit to produce the control signal; and selectively adjusting a transistor coupled between the regulated power supply terminal and ground based on the control signal.

12. The method of claim 7, wherein controlling the supply current to the regulated power supply terminal comprises generating a bias current using a current mirror coupled to a transistor of the low frequency responsive circuit.

13. The method of claim 7, wherein modulating the supply voltage at the regulated power supply terminal comprises coupling the regulated power supply terminal to a control terminal of a shunt transistor through a capacitor to control current flow through the shunt transistor based on high frequency current variations in the supply voltage at the regulated power supply terminal.

14. A circuit comprising:

a series regulator circuit adapted to be coupled to a power supply and configurable to provide a regulated power supply voltage to a regulated power supply terminal based on the power supply: the series regulator circuit comprising:

an amplifier circuit including a first input coupled to a reference voltage, a second input coupled to one of a feedback signal and a regulated power supply, and an output;

a transistor coupled between the power supply and the regulated power supply terminal and including a gate coupled to the output of the amplifier; and a shunt regulator circuit coupled to the regulated power supply terminal and to ground, the shunt regulator circuit configurable to shunt high frequency components of the regulated power supply voltage to ground.

15. The circuit of claim 14, wherein the transistor is responsive to the control output of the amplifier circuit to control the regulated power supply voltage.

16. The circuit of claim 15, wherein the shunt regulator circuit comprises:

a second amplifier circuit including a second reference input configured to receive a second reference voltage signal, a second input, and an output;

a capacitor coupled between the regulated power supply terminal and the second input; and a second transistor coupled between the regulated power supply terminal and ground, the second transistor including a gate coupled to the output of the second amplifier circuit.

17. The circuit of claim 15, wherein the shunt regulator circuit comprises:

a bias generator circuit coupled between the regulated power supply terminal and ground;

a shunt control circuit coupled to the bias generator circuit and configured to produce a control signal; and a shunt transistor coupled between the regulated power supply terminal and ground, the shunt transistor including a gate terminal to receive the control signal.

18. The circuit of claim 17, wherein the shunt control circuit amplifies high frequency variations of the regulated power supply voltage to produce the control signal.

19. The circuit of claim 14, wherein the series regulator circuit is programmable based on the reference voltage.

20. The circuit of claim 14, wherein the series regulator circuit comprises:

a current mirror coupled to the output of the amplifier and configured to control the supply current based on an output signal at the output of the amplifier, the current mirror including the transistor.

* * * * *